US007607334B2

(12) United States Patent
Lechasseur

(10) Patent No.: US 7,607,334 B2
(45) Date of Patent: Oct. 27, 2009

(54) BENDING HEAD

(76) Inventor: André Lechasseur, 5500, Chemin Côte St-Luc, Montreal, Quebec (CA) H3X 2C7

( * ) Notice: Subject to any disclaimer, the term of this patent is extended or adjusted under 35 U.S.C. 154(b) by 0 days.

(21) Appl. No.: 12/318,181

(22) Filed: Dec. 23, 2008

(65) Prior Publication Data

US 2009/0165527 A1 Jul. 2, 2009

(30) Foreign Application Priority Data

Dec. 31, 2007 (GB) ..... 0725364.4

(51) Int. Cl.
*B21D 5/16* (2006.01)
*B21J 13/00* (2006.01)

(52) U.S. Cl. ..... 72/452.5; 72/408; 72/413; 83/557; 29/243.5; 29/243.58

(58) Field of Classification Search ..... 72/407, 72/408, 413, 452.3, 452.5, 453.16; 83/557, 83/623; 29/243.5, 243.57, 243.58
See application file for complete search history.

(56) References Cited

U.S. PATENT DOCUMENTS 2,783,668 A * 3/1957 Frolich ..... 72/408
3,213,817 A * 10/1965 Hunziker ..... 29/243.57
3,777,687 A * 12/1973 Colman, Jr. ..... 29/243.58
3,987,740 A * 10/1976 Merson ..... 29/243.58
4,145,907 A * 3/1979 Barber et al. ..... 72/318
4,176,541 A * 12/1979 Cooper ..... 72/474
5,090,101 A * 2/1992 Welty ..... 29/243.5
6,345,526 B1 * 2/2002 Deriaz et al. ..... 72/408
6,578,404 B1 * 6/2003 Rousseau ..... 72/413

* cited by examiner

*Primary Examiner*—David B Jones

(57) ABSTRACT

A bending head for bending the peripheral edge of a sheet of material, the bending head being usable with a power source. The bending head includes an anvil member, the anvil member defining a substantially elongated anvil surface. A hammer member is movable relatively to the anvil member substantially perpendicularly to the anvil surface. An actuator is provided for receiving power from the power source, the actuator being operatively coupled to the hammer member for moving the hammer member relatively to the anvil member when the power source powers the actuator. The hammer member defines a hammer surface, the hammer surface being substantially elongated, the hammer surface substantially opposing the anvil surface so as to define a gap therebetween. The gap defines an entry point and a substantially longitudinally opposed exit point. The sheet of material is movable along the gap between the entry and exit points. The entry and exit points define respectively an entry transversal cross-sectional configuration and an exit transversal cross-sectional configuration. The entry and exit transversal cross-sectional configurations differ from each other. The gap has a transversal cross-sectional configuration that longitudinally transitions substantially smoothly between the entry and exit transversal cross-sectional configurations.

12 Claims, 4 Drawing Sheets

BENDING HEAD

FIELD OF THE INVENTION

The present invention relates generally to tool attachments for hand-held power tools and, more particularly, to a bending head for attachment to a hand-held power tool for bending the edge of sheet metal and sheets of material.

BACKGROUND

Bending head attachments for hand-held power tools are known in the art and are useful in metalworking applications such as, for example, automotive body repair work, curtain wall systems installation and air duct assembly. Bending head attachments of the prior art generally consist of an anvil member provided with support means for rigidly fastening the latter to the main body of a hand power tool driving a reciprocating member. A movable hammer member, generally pivotably mounted on the support means of the head attachment, is articulated by the reciprocating member of the power tool such that its hammer head portion performs a reciprocating movement against the comparatively fixed anvil member. The hammer head and anvil members generally have correspondingly-shaped configurations that can be imbricated into one another such as, for example, two elongated members that are both having V-shaped cross-sections, or half-circular cross-sections, or the like, depending on the desired bend along the sheet metal edge.

In use, the hand power tool equipped with the bending head attachment is turned on and the sheet metal engaging portion of the head attachment is progressively engaged along the peripheral edge of a sheet metal to be bent. As the head attachment is moved longitudinally along the edge, the reciprocating action of the hammer head against the anvil member incrementally bends an edge portion of the sheet metal.

Some examples of the prior art are U.S. Pat. No. 3,777,687, to Colman (1973), U.S. Pat. No. 4,145,907, to Barber et Al. (1979), U.S. Pat. No. 4,176,541, to Cooper (1979), and U.S. Pat. No. 6,578,404 B1, to Rousseau (2003).

While these prior art devices generally offer a bending head attachment for hand-held power tools for longitudinally bending the edge of sheet metal, they also entail one or more of the following disadvantages:

- they often leave impact marks or scores along the bent edge;
- they are generally designed for a specific thickness of sheet metal;
- they generally require a hand-held power tool offering a relatively powerful reciprocating drive member, which are power tools that are relatively less commercially available on the market and, thus, relatively more expensive as compared to rotary drive power tools such as hand-held power drills;
- they generally do not allow a bent edge to be reverted to its original planar configuration, such as when a portion of an edge has been bent erroneously, without having to replace selected components of the head attachment, such as the hammer head and/or the anvil members.

Against this background, there exist a need for a new and improved bending head. It is a general object of the present invention to provide a new and improved bending head.

SUMMARY OF THE INVENTION

In a broad aspect, the invention provides a bending head for bending the peripheral edge of a sheet of material, the bending head being usable with a power source. The bending head includes an anvil member, the anvil member defining a substantially elongated anvil surface. A hammer member is movable relatively to the anvil member substantially perpendicularly to the anvil surface. An actuator is provided for receiving power from the power source, the actuator being operatively coupled to the hammer member for moving the hammer member relatively to the anvil member when the power source powers the actuator. The hammer member defines a hammer surface, the hammer surface being substantially elongated, the hammer surface substantially opposing the anvil surface so as to define a gap therebetween. The gap defines an entry point and a substantially longitudinally opposed exit point. The sheet of material is movable along the gap between the entry and exit points. The entry and exit points define respectively an entry transversal cross-sectional configuration and an exit transversal cross-sectional configuration. The entry and exit transversal cross-sectional configurations differ from each other. The gap has a transversal cross-sectional configuration that longitudinally transitions substantially smoothly between the entry and exit transversal cross-sectional configurations.

In some embodiments of the invention, the fixed anvil member and movable hammer member are typically implemented by a pair of correspondingly-shaped elongated members defining opposing surfaces having progressively profiled cross-sections that are starting as substantially planar at one end, to a progressively rounded parabolic shape at the opposite end of the pair. The planar end of the pair of elongate members generally defines the entry point, or sheet engaging end, of the bending head attachment, while the rounded parabolic end of the pair defines the exit point.

In some embodiments of the invention, projecting perpendicularly from the opposite side of the sheet engaging side of the of the bending head attachment, there is a rotatable drive shaft that is linked to an internal rotary drive mechanism providing a reciprocating movement to the hammer member within a hammer guiding means. Furthermore, the internal rotary drive mechanism is equipped with resilient cushioning means for allowing the head attachment to perform edge bending operations on sheet material panels having relatively varied thicknesses.

Typically, to attach the bending head attachment to a hand-held rotary power tool, the chuck of the latter is first firmly tightened on the rotatable drive shaft of the head attachment, followed with attachment of the support means of the head attachment to the main body of the hand power tool using an attachment, such as an anchoring screw. To use the bending head attachment, the power tool is turned on and the sheet material engaging portion of the head attachment is straddle-engaged, preferably over an end corner of the edge to bend. The power tool is then progressively moved forwardly along the edge, thus gradually incrementally bending the latter.

It is to be noted that the progressively profiled cross-sections of the correspondingly-shaped anvil and hammer members allow to revert a bent edge to its original planar configuration by simply engaging one end of the bent edge through the exit point of the operating head attachment and move the latter rearwardly along the edge.

The relatively smooth, professionally looking bent edges that can be achieved with the bending head attachment of the present invention are useful, for example, for bending the peripheral edges of aluminium composite panels (ACP) commonly used in decorative curtain wall systems for displaying corporate colors and logos around the exterior walls of gas station franchises, grocery store chains and the like. In such applications, it is advantageous to have a hand-held power tool that can perform on-site edge bending operations on ACP that leaves little or no impact marks, waving schemes or scores on the high-quality surface along the bent edges.

Although the bending head of the present invention is described in reference to bending operations on sheet metal, it is to be understood that the head attachment is applicable to any sheet material having comparable malleability characteristics as metal sheet.

The propose bending head has correspondingly-shaped anvil and hammer members that have progressively profiled cross-sections that create relatively high-quality, professionally looking longitudinal bends along the edge of sheet material, similarly to results that would be obtained if the full longitudinal length of the bend was formed by a substantially larger, stationary press machine using a single punch-press process.

The resilient cushioning elements integrated in the rotary drive mechanism creates bent edges having a cross-section displaying a constant radius, independently of the relatively varied thicknesses of sheet material to be bent.

Typically, the proposed bending head requires a commonly available, and generally relatively inexpensive rotary power tool for its operation, such as a right angle power drill.

The proposed bending head can readily revert a bent edge to its original planar configuration without having to change any component or apply any adjustment to the head attachment. The proposed bending head is also relatively simple and economical to produce.

Other objects, advantages and features of the present invention will become more apparent upon reading of the following non-restrictive description of preferred embodiments thereof, given by way of example only with reference to the accompanying drawings.

DETAILED DESCRIPTION

Figure 1:
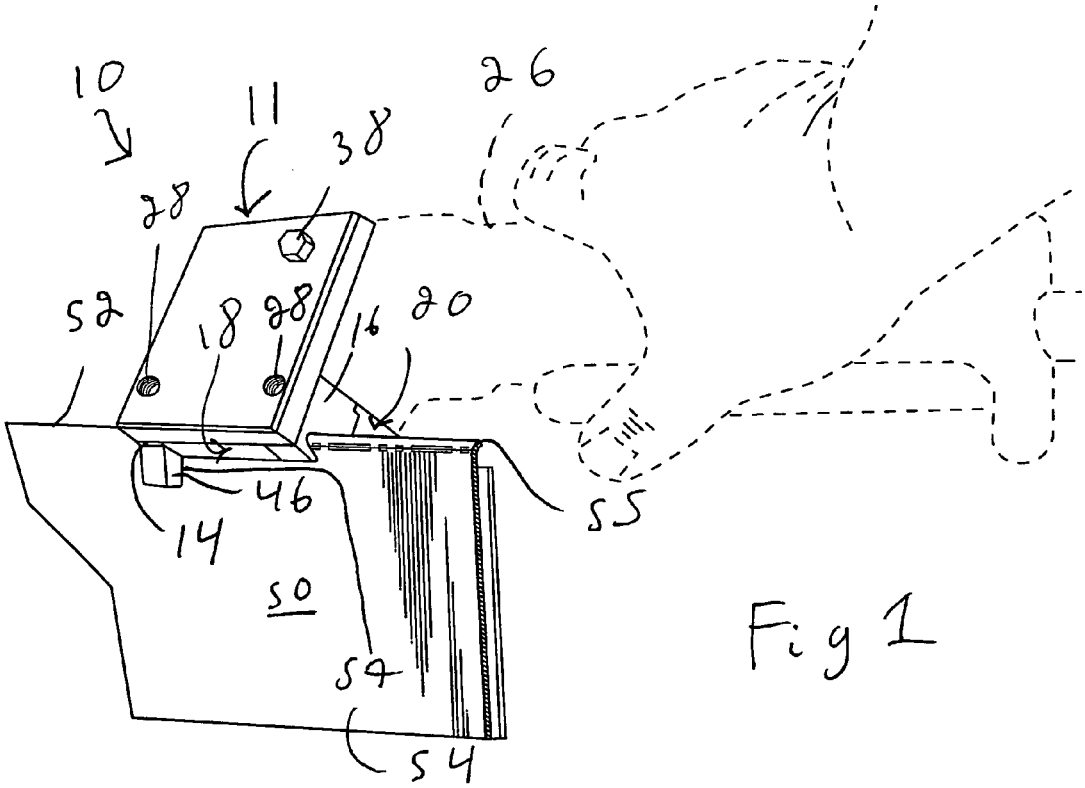
FIG. 1, in an environmental, top rear perspective view, illustrates a bending head according to an embodiment of the present invention, here shown attached to a hand-held rotary power tool and bending the protruding peripheral edge of a sheet of material.

Referring to FIG. 1, there is shown a bending head 10 according to an embodiment of the present invention. Generally speaking, the proposed bending head 10 is usable for bending the peripheral edge 52 of a sheet of material, such as for example sheet metal 54. The bending head 10 is usable with a power source, for example a rotary power source such as a hand-held rotary power tool 26, the rotary power source providing a rotational movement.

Figure 5:
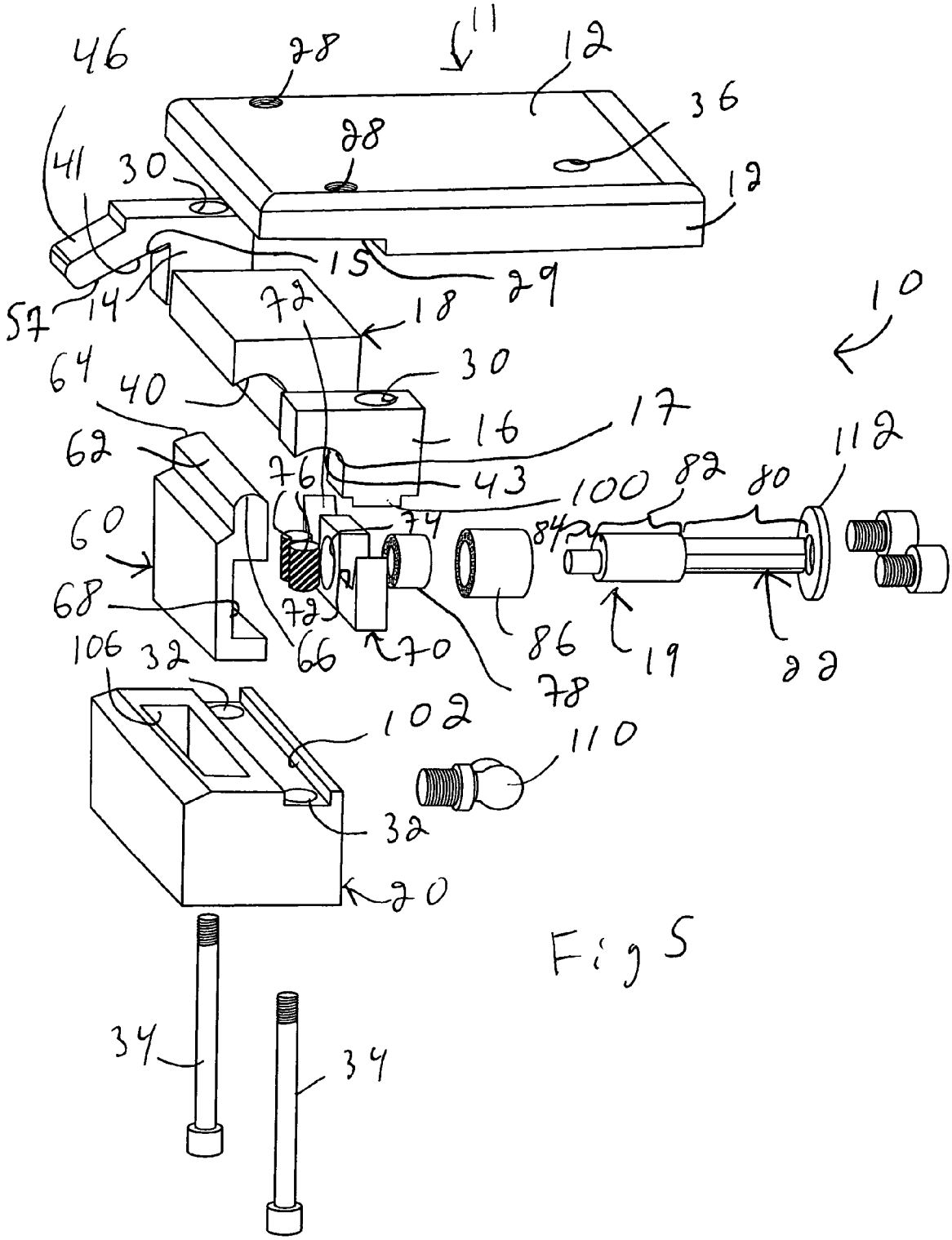
FIG. 5, in a top rear perspective exploded view, illustrates the bending head of FIG. 1.

Referring to FIG. 5, the bending head 10 includes an anvil member 18, the anvil member 18 defining a substantially elongated anvil surface 40. A hammer member 60 is movable relatively to the anvil member 18 substantially perpendicularly to the anvil surface 40. An actuator 19 is attachable to the power source, the actuator 19 being operatively coupled to the hammer member 60 for moving the hammer member 60 in a reciprocating movement relatively to the anvil member 18 when the power source powers the actuator 19. The hammer member 60 defines a hammer surface 62, the hammer surface 62 being substantially elongated, the hammer surface 62 substantially opposing the anvil surface 40 so as to define a gap therebetween. The gap defines an entry point 64 and an exit point 66. The sheet of material 54 is movable along the gap between the entry and exit points 64 and 66. The entry and exit points 64 and 66 define respectively an entry transversal cross-sectional configuration and an exit transversal cross-sectional configuration. The entry and exit transversal cross-sectional configurations differ from each other. The gap has a transversal cross-sectional configuration that longitudinally transitions substantially smoothly between the entry and exit transversal cross-sectional configurations.

Figure 2:
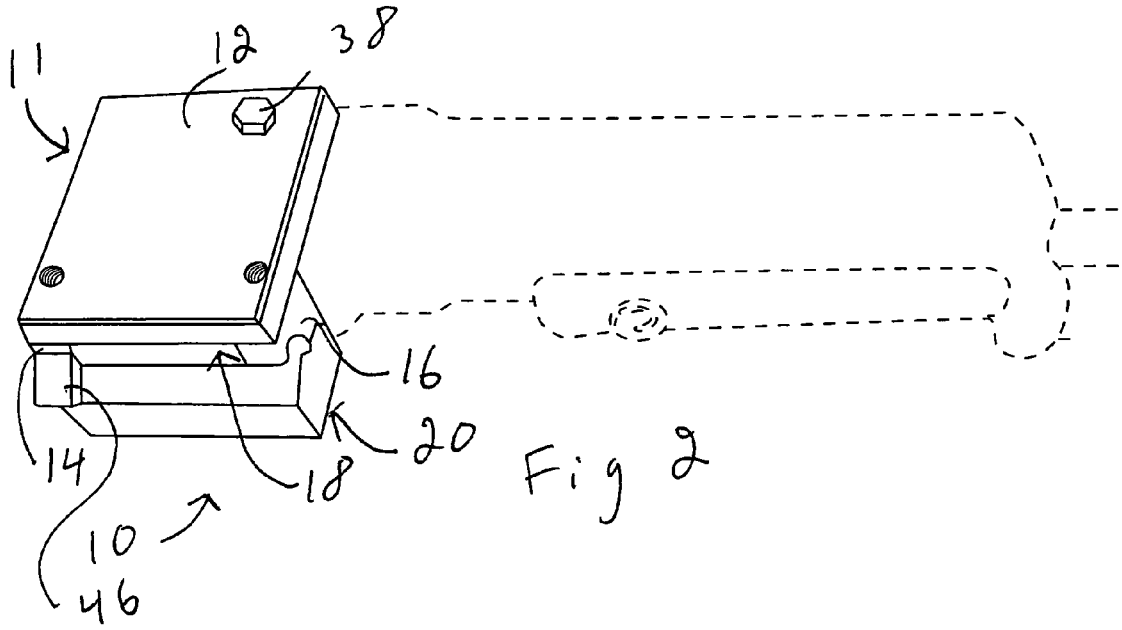
FIG. 2, in an environmental, top rear perspective view, illustrates the bending head of FIG. 1, shown attached to a hand-held rotary power tool.
Figure 3:
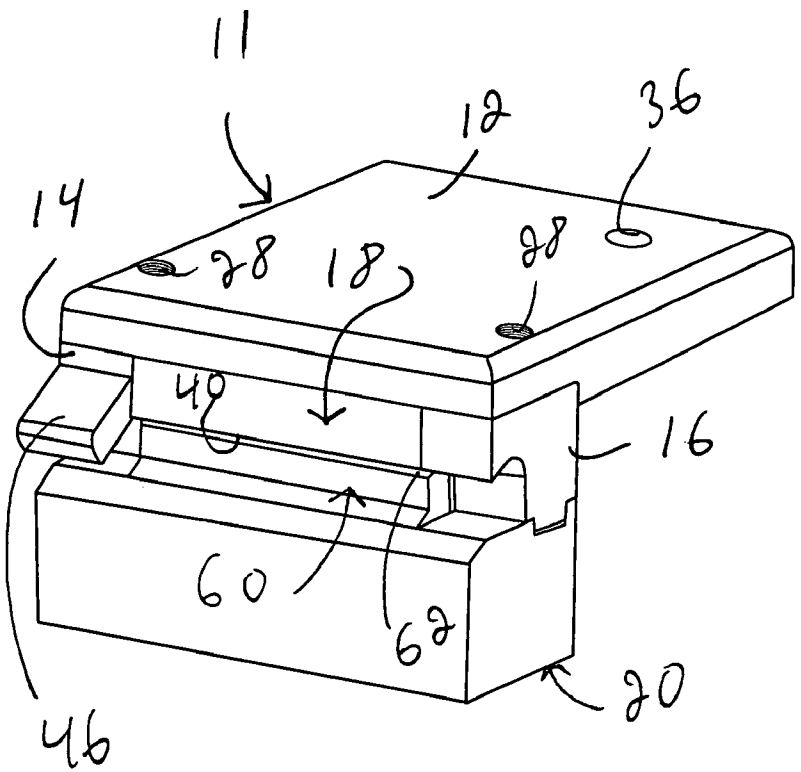
FIG. 3, in a top perspective view, illustrates the bending head attachment of FIG. 1, showing the sheet material engaging side of the bending head.

With reference to FIGS. 2 and 3, The bending head 10 generally comprises a base 11. The base 11 includes a substantially square mounting plate 12 to which are rigidly mounted along an underside edge of the latter, oppositely disposed entry guiding block 14 and exit guiding block 16, separated by the substantially elongated, intermediate anvil member 18. The base 11 also includes a substantially elongated hammer guide block 20 fixedly mounted to the underside of the entry and exit guiding blocks 14 and 16.

Figure 4:
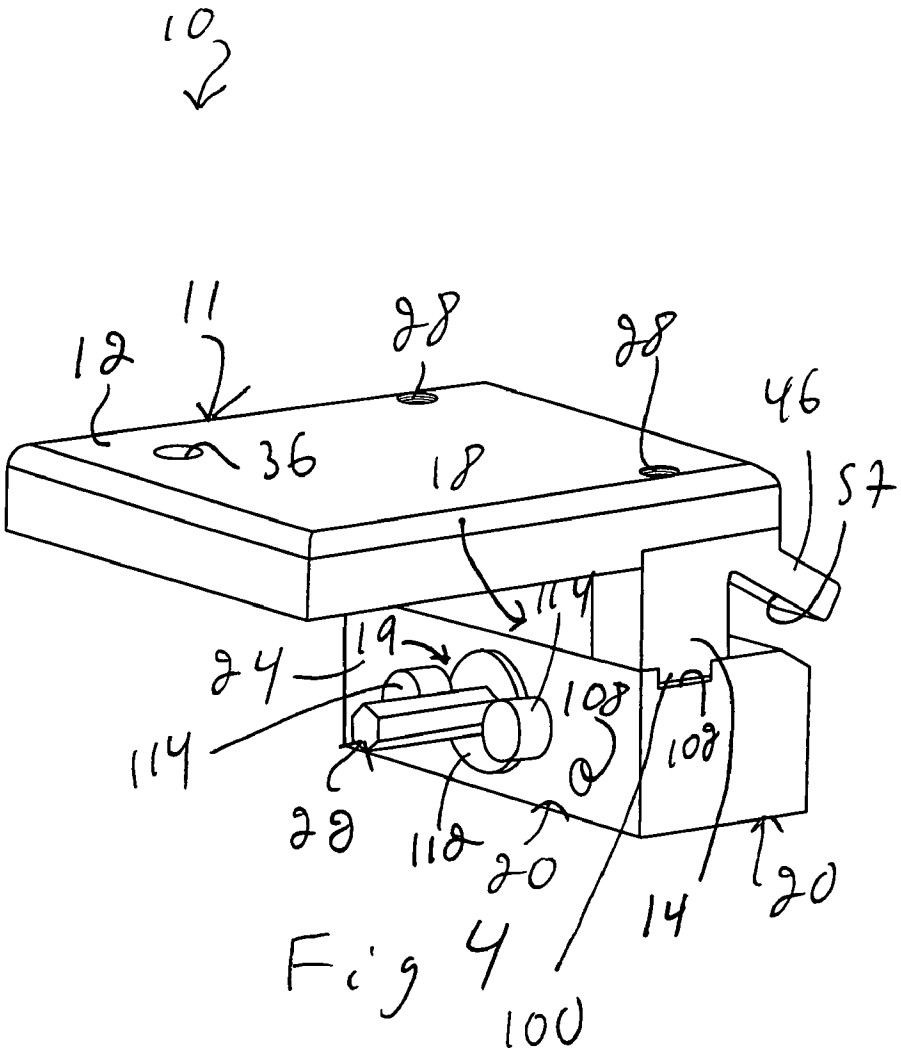
FIG. 4, in a top perspective view, illustrates the bending head attachment of FIG. 1, showing the power tool engaging side of the bending head.

FIG. 4 further shows that the actuator 19 includes a rotatable drive shaft 22 perpendicularly projecting from the side 24 of the hammer guide block 20 that is opposed to the gap between the anvil and hammer members 18 and 60. The drive shaft 22 is adapted to be received in a conventional drill-bit holder, or chuck (not shown) of a rotary power unit such as, for example, a hand-held right-angle power drill 26, as illustrated in FIGS. 1 and 2. The drive shaft 22 is described in detail hereinbelow.

Now referring to FIG. 5, which shows an exploded view of the bending head 10, the mounting plate 12 has a longitudinally extending, recessed portion 29 provided along an underside edge thereof that is adapted to engagingly receive the substantially planar upper portion of the entry and exit guiding blocks 14 and 16 and of the anvil member 18.

Mounting plate 12 is provided with a pair of spaced apart threaded apertures 28 that are in communication with corresponding apertures 30 extending through the entry and exit guiding blocks 14 and 16. Also, apertures 32 are extending through the hammer guide block 20. Each threaded apertures 28 is substantially coaxial with one the apertures 30 and one of the apertures 32 and is provided for receiving therein a threaded clamping screws 34. Thus, clamping screws 34 allow to secure the entry and exit guiding blocks 14 and 16 and the anvil member 18 between hammer guide block 20 and the underside of the mounting plate 12.

Mounting plate 12 is further provided with an attachment for attaching the power tool to the bending head 10. For example, the attachment takes the form of an anchoring aperture 36 adapted to receive a threaded fastener 38 for rigidly fastening the bending head 10 to the hand-held power tool 26, as illustrated in FIGS. 1 and 2. It is to be noted that the anchoring aperture 36 is positioned to be in communication with one of two diametrically opposed threaded apertures (not shown). commonly found on either side of and relatively near the rotary spindle head of a hand-held power tool, for fastening a laterally extending handle bar on either the left or right side of the power tool.

Figure 6:
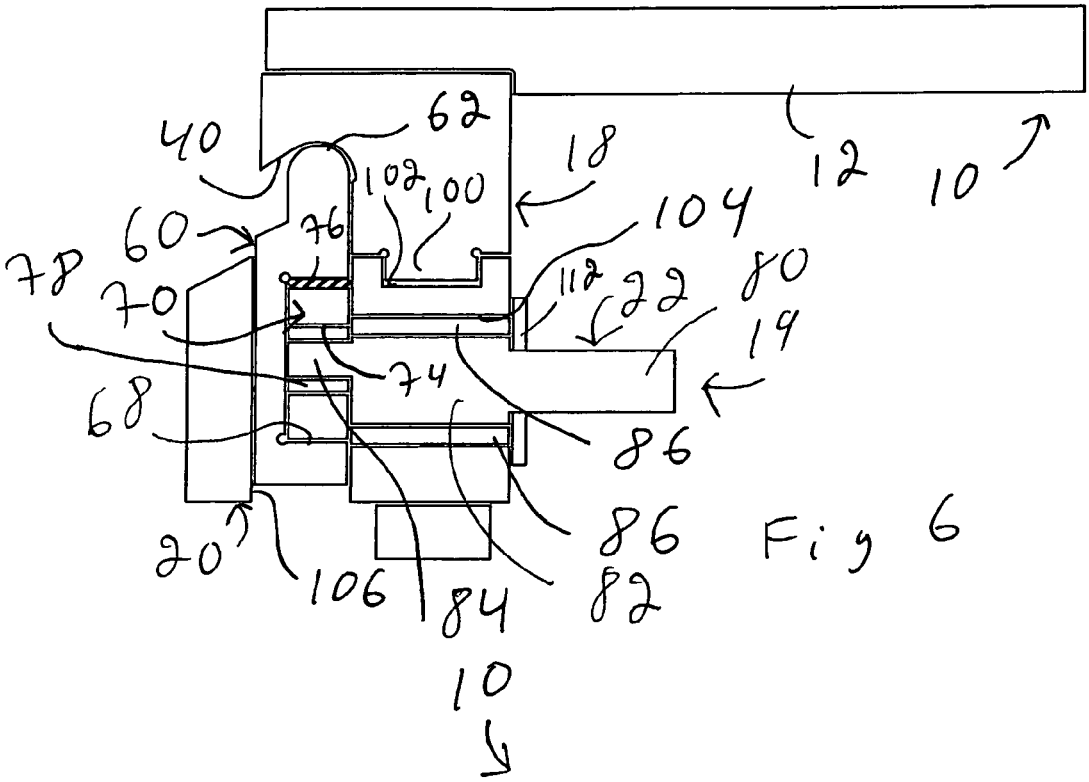
FIG. 6, in a transversal cross-sectional view, illustrates the bending head of FIG. 1, the bending head being shown with a hammer member thereof in a proximal position relative to an anvil member thereof.
Figure 7:
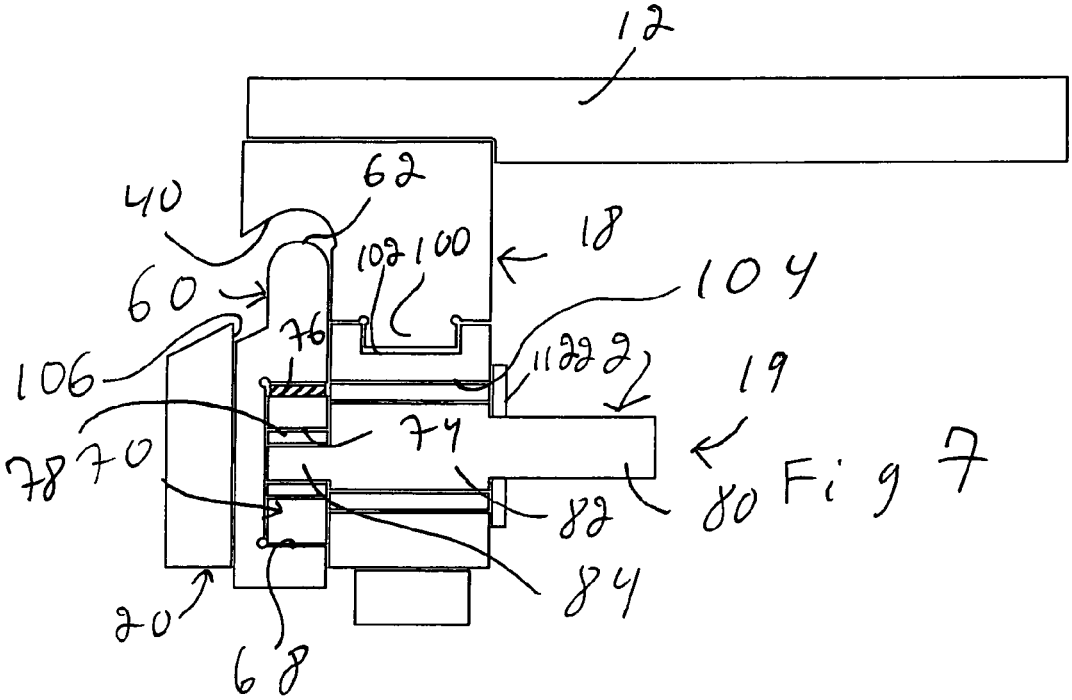
FIG. 7, in a transversal cross-sectional view, illustrates the bending head of FIG. 1, the bending head being shown with a hammer member thereof in a distal position relative to an anvil member thereof.

As seen in FIGS. 6 and 7, the anvil member 18 has a transversal cross-section roughly resembling a numeral seven in which the side of the anvil member 18 opposed to the mounting plate 12 defines the elongated anvil surface 40 longitudinally extending the full length of the anvil member 18. The anvil surface 40 is correspondingly formed to receive therein a profiled hammer surface 62 of the hammer member 60, both of which will be described in detail hereinafter.

The entry and exit guiding blocks 14 and 16, along with the anvil member 18 and the hammer member 60, are removably mountable to the base 11, which allows for the selection of components having a configuration suitable for bending the sheet of material 54 in a desired shape by exchanging these components.

Referring to FIG. 5, entry and exit guiding blocks 14 and 16 have correspondingly shaped recessed extensions of the anvil surface 40 defined at the entry point 64 and exit point 66 respectively of the gap created between the anvil and hammer members 18 and 60. These recessed extensions create an entry guiding surface 41 and an axially located exit guiding surface 43, the anvil surface 40 extending between the entry and exit guiding surfaces 41 and 43. The entry guiding surface 41 has an entry surface transversal cross-sectional configuration substantially similar to the transversal cross-sectional configuration of the anvil surface 40 at the entry point 64. Similarly, the exit guiding surface 43 has an exit surface transversal cross-sectional configuration substantially similar to the transversal cross-sectional configuration of the anvil surface at the exit point 66.

As can be observed in FIG. 5, the entry guiding block 14 has a substantially V-shaped recess defining a pointed apex 15, while the exit guiding block 16 has a substantially rounded recess defining a curved apex 17. Therefore, the entry transversal cross-sectional configuration is substantially rectilinear and the exit transversal cross-sectional configuration is substantially arcuate. In some embodiments of the invention, the exit transversal cross-sectional configuration is substantially parabolic.

In some embodiments of the invention, the entry guiding block 14 defines a guiding lip 46 protruding substantially laterally outwardly therefrom substantially adjacent to the entry point 64 for abuttingly engaging the top surface 50 of the peripheral edge 52 of the sheet metal 54 to be bent (as illustrated in FIG. 1). Referring to FIG. 5, the guiding lip 46 defines a substantially planar lip guiding surface 57 extending in a substantially coplanar relationship relatively to the anvil surface 40 at the entry point 64.

A ridge 100 projecting substantially away from the mounting plate 12 extends longitudinally along the surface of the contiguously assembled entry and exit guiding blocks 14 and 16 and intermediate anvil member 18. The ridge 100 is shaped to be engaged in a correspondingly-shaped, substantially elongated linear slot 102 provided along an edge of the surface of the hammer guide block 20 that faces the ridge 100.

Hammer guide block 20 is provided with a hammer guide for slidably receiving the hammer member 60 thereinto, the hammer guide extending substantially perpendicularly to the anvil surface 40. For example, the hammer guide takes the form of a hammer receiving passageway 106 extending substantially perpendicularly to the anvil surface 40 through the hammer guide block 20 for slidably receiving therein the compatibly-shaped hammer member 60. As seen in FIGS. 6 and 7, hammer guide block 20 is further provided with a shaft mounting aperture 104 extending substantially laterally outwardly from the hammer receiving passageway 106, the drive shaft 22 being mounted in the shaft mounting aperture 104 so as to be rotatable about the shaft longitudinal axis. Typically, an anti-friction element such as a needle bearing 86 is provided between the shaft mounting aperture 104 and the drive shaft 22.

An additional aperture 108 (as best shown in FIG. 4), which is preferably threaded, is also extending through the hammer guide block 20 to lead into the hammer receiving passageway 106 and receives therein a threaded plug or grease zert 110, as best illustrated in FIG. 5. Grease zert 110 allows for periodic maintenance lubrication of movable hammer member 60 within the assembled bending head 10.

The portion of the hammer surface 62 provided substantially adjacent to the entry point 64 has a cross-sectional shape generally resembling the pointed portion of an isosceles right triangle, with the sloped side generally pointing inwardly in the bending head 10, while the portion of the hammer surface 62 provided substantially adjacent to the exit point 66 has a substantially uniformly rounded, parabolic cross-sectional shape. Thus, the longitudinally profiled shape of hammer surface 62 gradually and smoothly changes from a substantially angled planar surface to a progressively rounded parabolic shape. Furthermore, compared to a horizontal reference defined by the mounting plate 12, the acute apex of the hammer surface 62 substantially adjacent to the entry point 64 is slightly closer to the mounting plate 12 than the rounded apex of the hammer surface 62 substantially adjacent to the exit point 66.

It is to be understood that the anvil and hammer surfaces 40 and 62 may have any other suitable shapes. For example, instead of bending an edge to a rounded configuration, the exit point 64 of the gap may have a right-angle bend, a V-shaped groove, or the like, along the peripheral edge 52 of the sheet metal 54.

As seen in FIG. 5, the hammer member 60 defines a guiding rail extending substantially parallel to the hammer surface 62, the shaft mounting aperture 108 extending substantially away from the guiding rail. For example, the guiding rail is created by a slot 68 extending along the hammer member 60 substantially spaced apart from the hammer surface 62 and substantially perpendicularly to the hammer receiving passageway 106 for slidably receiving therein a carriage 70. For example, the slot 68 is created in a substantially C-shaped portion of the hammer member 60.

The carriage 70 is generally defined by an elongated member defining a pair of substantially U-shaped recesses 72 disposed in a side-by-side configuration, a carriage aperture 74 extending through the carriage 70 between the recesses 72. The pair of U-shaped recesses 72 are opened in a direction leading generally toward the mounting plate 12 and each receive a resilient cushioning elements 76 made of, for example, urethane or the like, that is substantially occupying the space provided therein, except for a portion of the cushioning elements 76 which is protruding away from the carriage 70 towards the mounting plate 12.

In other words, the hammer member 60 is reciprocating between a proximal position, seen in FIG. 6, and a distal position, seen in FIG. 7. The hammer member 60 is closer to the anvil member 18 in the proximal position than in the a distal position. The actuator 19 includes the cushioning elements 76 which are operatively coupled to the hammer member 60 for allowing variations in a distance between the hammer and anvil surfaces 62 and 40 when the hammer member 60 is in the proximal position. The cushioning elements 76 allow for a substantially constant radius bend for various thickness of sheet metal 54 to be bent.

Carriage aperture 74 is provided for receiving, in a substantially snug fit, a cylindrical anti-friction element such as a needle bearing 78. The assembled carriage 70, including the cushioning elements 76 and needle bearing 78, is adapted to be resiliently slidably inserted in the slot 68 of the hammer member 60.

Referring to FIG. 5, the rotatable drive shaft 22 is generally defined by a substantially elongate member having a hex-shaped, power tool engaging section 80, a relatively diametrically larger, cylindrical mid-section 82, for rotatably engaging the needle bearing 86 positioned in the shaft mounting aperture 104 of the hammer guide block 20, and a relatively diametrically smaller hammer member coupler 84 located at the end of the drive shaft 22, the hammer member coupler 84 typically having a substantially cylindrical configuration, for engaging in needle bearing 78 positioned in carriage aperture 74 of carriage 70. Cylindrical mid-section 82 and hammer member coupler 84 are preferably of longitudinal lengths substantially similar to that of their corresponding shaft mounting aperture 104 and carriage aperture 74 respectively. Furthermore, the hammer member coupler 84 has a slightly eccentric longitudinal axis relative to sections 80 and 82.

A retaining element such as, for example, a flat washer 112, cooperatively with a pair of set screws 114 and corresponding threaded holes (not shown) in hammer guide block 20, holds drive shaft 22 rotatably mounted within the assembled bending head 10 (as illustrated in FIG. 4). It is to be noted that any other suitable retaining element may be used as well to hold rotatable drive shaft 22 in place. Therefore, the hammer member coupler 84 is coupled to the hammer member 60 in a manner such that the hammer member 60 is movable along the hammer receiving passageway 106 substantially jointly with the hammer member coupler 84.

Thus, when a source of rotary power is applied to the tool engaging section 80 of rotatable drive shaft 22, the hammer member coupler 84 engaged in needle bearing 78 of carriage 70 induces a circular movement to the latter around the longitudinal central axis of axially aligned sections 80 and 82 of the drive shaft 22. All the while, the carriage 70 is performing a reciprocating movement within linear slot 68 of hammer member 60 which, consequently, induces a reciprocating movement to the latter within the hammer receiving passageway 106.

The bending head 10 is preferably made of any suitable rigid material such as, for example, steel, aluminium, brass, Teflon®, or the like, or a combination of these, depending on the malleability of the target sheet metal to be bent. Furthermore, it is to be noted that all the components of the bending head 10 may be appropriately sized, with varied relative proportions between the components, to suit a particular application. For example, the correspondingly-shaped anvil surface 40 and hammer surface 62 may be configured to bend a substantially wider peripheral edge of a sheet metal.

To use the bending head 10, a hand-held rotary power tool such as the right angle drill 26 illustrated in FIGS. 1 and 2, must have its chuck tightly gripping the tool engaging section 80 of drive shaft 22, and the anchoring screw 38 should be tightly securing the bending head 10 to the main body of power tool 26.

In use, as illustrated in FIG. 1, the guiding surface 57 is first abuttingly engaged on the top surface of an end corner 55 of the sheet metal 54 to be bent until the edge of the latter comes abutting against the apex 15 of the V-shaped recess of entry guiding block 14. With the general longitudinal axis of the anvil surface 40 of the anvil member 18 generally maintained axially aligned with the longitudinal axis of the peripheral edge 52, the user may turn on the power tool 26 while starting to forwardly and progressively engage the bending head 10 along the peripheral edge 52. Hence, the generally planar surface of the end corner 55 progressively enters the relatively small co-planar clearance at the entry point each time the hammer member 60 is in the distal position of its reciprocating cycle. Thus, the reciprocating action of the profiled hammer surface 62 incrementally bends the peripheral edge 52 against the corresponding anvil surface 40, from an essentially planar configuration when the peripheral edge 52 progressively enters the entry point 64 to a rounded configuration when it exits its at the exit point 66.

In a manner readily apparent to one skilled in the art of metalworking, the thickness and malleability of the sheet metal to be bent, in cooperative relation with the resiliency of the cushioning elements 76, will dictate the appropriate modulation of the forward speed and pressure to be applied by the user on the hand-held power tool 26 such that a uniform, professional looking bend is obtained along the peripheral edge 52.

It is to be noted that the bending head 10 can as well be used to flatten, or revert an existing rounded edge 53 to a planar configuration by moving the attachment head 10 in a reverse direction.

Although the above description contains many specificities, these should not be construed as limitations on the scope of the invention but as merely providing one illustration of the presently preferred embodiment of this invention. For example, mounting plate 12, entry and exit guiding blocks 14 and 16 and anvil member 18 may all be molded as a single-piece element using a conventional molding process. Also, a thin layer of material, such as a fabric, Teflon®, or the like, may cover the anvil surface 40 and hammer surface 62 for an even better protection of the sheet metal to be bent. Yet another example is a bending head 10 that would be made an integral part of a dedicated rotary power tool, which may be either a portable or stationary power tool.

Although the present invention has been described hereinabove by way of preferred embodiments thereof, it can be modified, without departing from the spirit and nature of the subject invention as defined in the appended claims.

What is claimed is:

1. A bending head for bending the peripheral edge of a sheet of material, said bending head being usable with a power source, said bending head comprising:

an anvil member, said anvil member defining a substantially elongated anvil surface;

a hammer member movable relatively to said anvil member substantially perpendicularly to said anvil surface; and an actuator for receiving power from said power source, said actuator being operatively coupled to said hammer member for moving said hammer member in a reciprocating movement relatively to said anvil member when said power source powers said actuator;

said hammer member defining a hammer surface, said hammer surface being substantially elongated, said hammer surface substantially opposing said anvil surface so as to define a gap therebetween, said gap defining an entry point and a substantially longitudinally opposed exit point, said sheet of material being movable along said gap between said entry and exit points, said entry and exit points defining respectively an entry transversal cross-sectional configuration and an exit transversal cross-sectional configuration, said entry and exit transversal cross-sectional configurations differing from each other, said gap having a transversal cross-sectional configuration that longitudinally transitions substantially smoothly between said entry and exit transversal cross-sectional configurations;

said hammer member reciprocating between a proximal position and a distal position, said hammer member being closer to said anvil member in said proximal position than in said distal position, said actuator including a resilient member operatively coupled to said hammer member for allowing variations in a distance between said hammer and anvil surfaces when said hammer member is in said proximal position, whereby sheets of material having different thicknesses are insertable between said anvil and hammer surfaces.

2. A bending head as defined in claim 1, wherein said power source is a rotary power source providing a rotational movement; and said actuator is a rotary drive, said rotary drive being operatively coupled to said hammer member for moving said hammer member in said reciprocating movement relatively to said anvil member when said rotary power tool provides said rotational movement.

3. A bending head as defined in claim 2, further comprising a base, wherein said actuator includes a drive shaft attachable to said rotary power source, said drive shaft defining a drive shaft longitudinal axis, said actuator also including a hammer member coupler extending substantially longitudinally from said drive shaft, said hammer member coupler being eccentric relatively to said drive shaft longitudinal axis;

said base includes a hammer guide block defining a hammer receiving passageway extending substantially perpendicularly to said anvil surface for slidably receiving said hammer member thereinto, said base also defining a shaft mounting aperture extending substantially laterally outwardly from said hammer receiving passageway, said drive shaft being mounted in said shaft mounting aperture so as to be rotatable about said shaft longitudinal axis;

said hammer member coupler being coupled to said hemmer member in a manner such that said hammer member is movable along said hammer receiving passageway substantially jointly with said hammer member coupler;

whereby rotating said drive shaft about said drive shaft longitudinal axis rotates said hammer member coupler about said drive shaft longitudinal axis to create a periodic variation in a distance between said hammer member coupler and said anvil member, thereby causing said reciprocating movement of said hammer member relatively to said anvil member.

4. A bending head as defined in claim 3, wherein said hammer member defines a guiding rail extending substantially parallel to said hammer surface, said shaft mounting aperture extending substantially away from said guiding rail; and said actuator includes a carriage mountable to said guiding rail so as to be movable therealong, said carriage defining a carriage aperture, said hammer member coupler being mounted into said carriage aperture.

5. A bending head as defined in claim 1, wherein said entry transversal cross-sectional configuration is substantially rectilinear and said exit transversal cross-sectional configuration is substantially arcuate.

6. A bending head as defined in claim 1, wherein said exit transversal cross-sectional configuration is substantially parabolic.

7. A bending head as defined in claim 1, further comprising a base, said base including a hammer guide block defining a hammer receiving passageway extending substantially perpendicularly to said anvil surface for slidably receiving said hammer member thereinto, said anvil member being removably mountable to said base.

8. A bending head as defined in claim 7, wherein said base defines an entry guiding surface and an axially located exit guiding surface, said anvil surface being provided between said entry and exit guiding surfaces, said entry guiding surface having an entry surface transversal cross-sectional configuration substantially similar to a transversal cross-sectional configuration of said anvil surface at said entry point, said exit guiding surface having an exit surface transversal cross-sectional configuration substantially similar to a transversal cross-sectional configuration of said anvil surface at said exit point.

9. A bending head as defined in claim 8, wherein said entry and exit guiding surfaces are respectively defined by an entry guiding block and exit guiding block, said entry and exit guiding blocks being removably attachable to the remainder of said base.

10. A bending head as defined in claim 1, wherein said bending head defines a guiding lip protruding substantially laterally outwardly relatively to said gap substantially adjacent to said entry point

11. A bending head as defined in claim 10, wherein said guiding lip defines a substantially planar lip guiding surface extending in a substantially coplanar relationship relatively to said anvil surface at said entry point.

12. A bending head as defined in claim 1, wherein said power source is a power tool, said bending head further comprising an attachment for attaching said power tool to said bending head.

* * * * *